US008360442B2

(12) United States Patent
Earls

(10) Patent No.: US 8,360,442 B2
(45) Date of Patent: Jan. 29, 2013

(54) METHOD AND APPARATUS FOR CARRYING OUT MAINTENANCE OF WEB HANDLING SHAFTS

(75) Inventor: Charles D. Earls, Morristown, TN (US)

(73) Assignee: Charles Earls, Morristown, TN (US)

( * ) Notice: Subject to any disclaimer, the term of this patent is extended or adjusted under 35 U.S.C. 154(b) by 739 days.

(21) Appl. No.: 12/506,472

(22) Filed: Jul. 21, 2009

(65) Prior Publication Data

US 2011/0016686 A1 Jan. 27, 2011

(51) Int. Cl.
*B62B 3/02* (2006.01)

(52) U.S. Cl. ..... 280/35; 29/402.04

(58) Field of Classification Search ..... 280/35, 280/47.34, 47.35, 79.3, 638, 639, 651; 29/281.4, 29/426.3, 402.04
See application file for complete search history.

(56) References Cited

U.S. PATENT DOCUMENTS

| | | | | | |
|---|---|---|---|---|---|
| 1,966,751 | A * | 7/1934 | Brefeld | 211/85.16 |
| 3,168,329 | A * | 2/1965 | Goldschmidt | 280/651 |
| 3,278,042 | A * | 10/1966 | Frydenberg | 410/32 |
| 3,388,943 | A * | 6/1968 | Clement | 296/21 |
| 3,503,525 | A * | 3/1970 | Loebner | 211/206 |
| 4,037,851 | A * | 7/1977 | Romero | 280/79.3 |
| 4,050,597 | A * | 9/1977 | Hawkins | 414/427 |
| 4,679,805 | A * | 7/1987 | Cunningham | 280/33.991 |
| D295,337 | S * | 4/1988 | Bogart | D34/17 |
| 4,771,531 | A * | 9/1988 | Asher | 29/426.3 |
| 4,784,004 | A * | 11/1988 | Ekola | 73/862.474 |
| 4,838,530 | A * | 6/1989 | Chyba et al. | 269/15 |
| 4,895,381 | A * | 1/1990 | Farlow | 280/33.997 |
| 5,256,238 | A * | 10/1993 | Gerber et al. | 156/361 |
| 5,505,578 | A * | 4/1996 | Fuller | 414/427 |
| 5,871,219 | A * | 2/1999 | Elliott | 280/79.3 |
| 6,095,745 | A * | 8/2000 | Garnett | 414/427 |
| 6,099,001 | A * | 8/2000 | Barresi | 280/79.6 |
| 6,170,141 | B1 * | 1/2001 | Rossway et al. | 29/281.1 |
| 6,270,094 | B1 * | 8/2001 | Campbell | 280/47.19 |
| 6,454,282 | B2 * | 9/2002 | Sexton et al. | 280/79.7 |
| 6,615,478 | B2 * | 9/2003 | Walker et al. | 29/559 |
| 6,773,222 | B1 * | 8/2004 | Gilchrist | 414/427 |
| 7,066,475 | B2 * | 6/2006 | Barnes | 280/35 |
| 7,200,913 | B2 * | 4/2007 | Laird et al. | 29/468 |
| 7,374,185 | B1 * | 5/2008 | Hollis | 280/47.35 |
| 7,611,126 | B2 * | 11/2009 | Vesa | 254/93 H |
| 7,815,202 | B2 * | 10/2010 | Richards et al. | 280/79.7 |
| D630,814 | S * | 1/2011 | Smith | D34/12 |
| 2003/0127834 | A1 * | 7/2003 | Click | 280/651 |
| 2003/0205874 | A1 * | 11/2003 | Kelly | 280/47.24 |

(Continued)

*Primary Examiner* — Katy M Ebner
*Assistant Examiner* — Brodie Follman
(74) *Attorney, Agent, or Firm* — Pitts & Lake, P.C.

(57) ABSTRACT

A system for exchange and reconditioning of winding or rewinding multi-components shafts associated with a web handling device comprising an omni-directional mobile cart having a plurality of subassemblies thereon for receiving, storing and transfer of one or more clean and/or to-be-reconditioned shafts between the web handling device and a maintenance station wherein a shaft is mounted in similar manner to the mounting of the shaft on the web handling device for disassembly, cleaning, repairing reassembly and storage of the clean shaft on the cart in anticipation for subsequent exchange of such clean shaft for a to-be-reconditioned shaft mounted on the web handling device. In the system, the removal of the to-be-reconditioned shaft from the web handling device, storage of this shaft on the cart and installation of a clean shaft previously stored on the cart are all performed without modification or material repositioning of the cart from its initially established position relative to the web handling device. A method for shaft exchange is disclosed.

8 Claims, 12 Drawing Sheets

U.S. PATENT DOCUMENTS

2004/0140649 A1* 7/2004 Faden ..... 280/651
2004/0150177 A1* 8/2004 Thiede et al. ..... 280/79.3
2005/0067360 A1* 3/2005 Darvial ..... 211/41.14
2005/0104308 A1* 5/2005 Barnes ..... 280/47.24
2008/0150244 A1* 6/2008 Carlei ..... 280/35
2009/0166999 A1* 7/2009 Mason et al. ..... 280/651
2010/0236043 A1* 9/2010 Garland et al. ..... 29/426.3
2012/0007343 A1* 1/2012 Webster et al. ..... 280/659
2012/0057954 A1* 3/2012 Bardin ..... 414/427

* cited by examiner

METHOD AND APPARATUS FOR CARRYING OUT MAINTENANCE OF WEB HANDLING SHAFTS

FIELD OF INVENTION

This invention relates to systems for the repair and/or maintenance (reconditioning) of shafts of web handling devices, such as those shafts employed in the slitting of webs of paper or polymeric film and collecting the cut webs in the form of precisely sized and shaped individual rolls.

BACKGROUND OF INVENTION

The present invention is particularly suited for repair and maintaining (hereinafter at times referred to as "reconditioning") winder shafts of slitter/winder devices designed to slit a relatively wide web into a plurality of more narrow webs, and collection of the slit webs on respective tubular cores carried on one or more rotating shafts. Commonly, such cores are of a paper or paperboard material. In such systems, it is highly desired that the collection of the slit webs be in a tightly wound roll having smooth planar opposite sides and be free of contamination associated with the passing of the web through the slitter/rewinder. Such precision commonly is dictated by the anticipated use of the slit rolls. Herein at times, the slitting and rewinding device in question may be referred to merely as a "slitter" for convenience purposes, rather than as a "slitter/rewinder" or as a "slitter/winder".

Commonly a plurality of relatively narrow webs derived from the slitting of a single web are collected onto respective paperboard cores mounted on rotating shafts disposed within the slitter. In at least one type slitter, the rewinding shaft employed to grasp and rotate the tubular cores comprises a plurality of individual annular collars disposed in side-by-side relationship along the length of the shaft. In this slitter, each collar is provided internally thereof with a plurality of detents which are loosely mounted in individual cavities defined in the outer circumferential wall of each collar. These detents are commonly round metal balls, a portion of each detent projecting beyond the outer circumferential surface of its respective collar to engage the inner wall of a core that surrounds the collar. These detents are biased radially outwardly of the collar by means of at least one air bladder that extends along the length of the shaft and internally of the collars.

In a typical slitter system, multiple paper-based cores are slid onto one end of a shaft and over the collars. In this action, the inner wall of a core is engaged by respective ones of the detents. In the course of operation of the slitter, the inner surface of each core "rubs" against the detents and/or the outboard rims of the cavities, creating minute dust particles comprising fibrous material of the cores. Dust also may be generated in the action of slitting a web into individual narrow webs. Such dust tends to migrate into the cavities in the collars, impeding the desired radial biasing of the detents for holding the core rigid with respect to the rotating shaft. Over time, such accumulations of dust may become dislodged and tend to be collected on the webs being rewound on the cores, thereby contaminating the web. Moreover, the presence of dust or the like on the slitter can have an adverse effect in connection with alignment of the cores with the output slit webs from the slitter.

Heretofore, reconditioning these shafts included removing the to-be-reconditioned shaft from the slitter, transporting it to a maintenance shop where it commonly was laid upon a work table, dissembled into its individual components, all of which are cleaned and re-lubricated as needed. As a part of this maintenance function, checking the air bladders for leaks can be a critical aspect of the reconditioning of a shaft. Specifically, when employing multiple winding shafts on a slitter, air is forced into each shaft to inflate the bladders of each such shafts to maintain the required pressure for maintaining the detents of the collars in proper frictional engagement with the core(s) mounted on the shaft so that the cores rotate properly for winding thereon of slit material onto the cores. If any one of the bladders leaks, the slitter operator must continually adjust the air pressure supplied from the slitter to leaking shaft to ensure proper rotation of the cores on such shaft. If the top shaft (for example) is leaking more severely than the bottom shaft, more pressure has to be applied to the top shaft than is supplied to the bottom shaft as required to ensure the same rotational speed of the cores on the two shafts which are simultaneously being fed slit material. Prior to the present invention there was no suitable means for efficiently checking for leaks in the bladders. Even new shafts direct from the manufacturer have been found to include a leaking bladder, indicating the absence in the art of bladder checking capability of the industry.

Following the cleaning in a typical prior shaft reconditioning procedure, the components of the shaft were reassembled and the reconditioned shaft was left on the table until needed for use as a change-over replacement shaft. When so stored, the shaft tended to collect dust or other contaminants associated with normal maintenance activities within the maintenance facility.

At all times, consideration is to be given to the relatively large cost of each of the shafts in question, the delicate nature of the components of the shaft, and the weight of a shaft which is not only a factor in lifting and handling a shaft, but the necessity of realignment of a heavy and cumbersome replacement shaft within the slitter itself.

Also, improper setup can be a source of many problems within the winding process of a slitter. Lack of proper setup can produce web breaks, excessive dusting, and, ultimately, increased waste and reduced product marketability. As a consequence, once a slitter/winder is properly setup for a given slitting/winding operation, desirably such setup is not altered until such operation is completed. The need for shaft maintenance can occur at any time during a given operation, thereby making it highly advantageous to carry out the shaft replacement without alteration of the setup of the slitter/winder. Even inadvertent alteration of the setup is to be minimized to the extent reasonably possible.

To minimize down time of the slitter, it is common practice to keep on hand an "extra" reconditioned shaft available for use as a replacement for the to-be-reconditioned shaft while such to-be-maintained shaft is being reconditioned and otherwise maintained in anticipation of its later reinstallation on the slitter.

Proper cleaning of dust from the winder shaft, of a slitter requires full removal of the shaft from the slitter, disassembly of the multiple collars, for example, from the shaft, cleaning of the shaft, cleaning of the collars, reassembly of the collars by threading the same onto a clean shaft, and reinstallation of the clean (reconditioned) shaft in proper precise alignment within the slitter proper.

Cleaning of the individual collars and their detents, etc. requires removal of the shaft from the slitter in that individual ones of the collars can be removed only by sliding them off an end of the shaft. Not uncommonly, each shaft and its collars may weigh more than 150 pounds and can require at least three workers as much as thirty minutes to disassemble the shaft from the slitter and replace it with a reconditioned shaft.

Accordingly, the cost involved in manual handling of the shaft is significant and the shaft is subjected to potential damage during manual handling.

Typically slitters are provided with at least two shafts mounted parallel to one another and in vertically spaced apart relationship to one another. To minimize the down time of a slitter of this type, commonly, it is desired to replace both shafts with clean shafts during any given maintenance event.

BRIEF SUMMARY OF THE INVENTION

In accordance with one aspect of the present invention, there is provided a manually movable omni-directional mobile cart adapted to be disposed proximate a slitter in position to receive thereon one or more of the windup shafts of the slitter, and to install a clean (reconditioned) shaft as a replacement for each removed shaft. The cart further serves, to convey such removed to-be-reconditioned shaft or shafts on the cart to a maintenance station where such shafts are transferred from the cart to a maintenance station which in part substantially mimics the mounting of the shaft on the slitter so that the shaft is oriented in cantilevered fashion for disassembly, cleaning, testing and reassembly thereof, and after repair and/or maintenance on the shaft, to return the shaft to the slitter or temporary storage on the mobile cart.

The mobile apparatus includes means for adjusting to the existing vertical height, horizontal location, and angular relationship of a given windup shaft of a slitter prior to removal of the shaft from the slitter, all without disruption or otherwise altering the existing operational settings for the slitter per se.

In a preferred embodiment, the mobile cart of the present invention is capable of receiving and simultaneously holding four shafts, e.g. a first upper reconditioned shaft and one to-be-reconditioned upper shaft disposed at a first vertical level of upper supporting arms of the cart, and a second bottom reconditioned shaft and a second bottom to-be-reconditioned shaft at a second vertical level of bottom supporting arms of the cart.

Employing this embodiment of the mobile cart permits a worker to position the mobile cart proximate the slitter and below the shaft to be removed, to remove the shaft to be reconditioned and then substitute the newly reconditioned shaft in place of the removed shaft, all without modification or disruption of the operational parameters of the slitter per se, or of the cart following its initial alignment with the to-be-reconditioned shaft in the slitter.

In accordance with one aspect of the present invention, the method of the present invention includes the steps of providing a manually movable cart having arm means adapted to store thereon at least one clean shaft, manually moving the cart into position, relative to a shaft on a slitter that is in need of repair or maintenance, adjusting the vertical height of the arm means to position such arm means immediately beneath, and in engagement with, the shaft on the slitter and in position to receive the shaft thereon, transferring the shaft from the slitter onto the cart, and, without change or adjustment of the position of the cart itself, transferring the clean shaft into alignment for its mounting on the slitter in place of the removed to-be-maintained shaft, mounting the clean shaft on the slitter, withdrawing the cart from the slitter, transfer of the cart and to-be-maintained shaft thereon to a remote maintenance station, within the maintenance station, hoisting the shaft off the cart and moving it into alignment with a mounting bracket which mimics the mounting bracket by means of which the shaft was mounted on the slitter, mounting one end of the to-be-maintained shaft on the maintenance station mounting bracket whereby the shaft projects in cantilevered fashion from the mounting bracket, disassembly of the components of the shaft, cleaning and/or repairing the shaft components, inflating the air bladders of the shaft and checking for leaks, reassembly of the shaft components on the shaft, and returning the clean shaft to the arms of the cart for future use as a clean replacement shaft.

Moreover, in accordance with one aspect of the present invention, the vertical height at which a shaft resides when removed from the slitter and loaded onto the cart remains unchanged so that the shaft supporting elements of the mobile cart remain fixed during receipt, storage, and transport of a shaft to and from the maintenance station thereby providing for minimal, if any vertical height adjustment of a reconditioned shaft when it is reinstalled within the slitter.

DETAILED DESCRIPTION OF INVENTION

Figure 1:
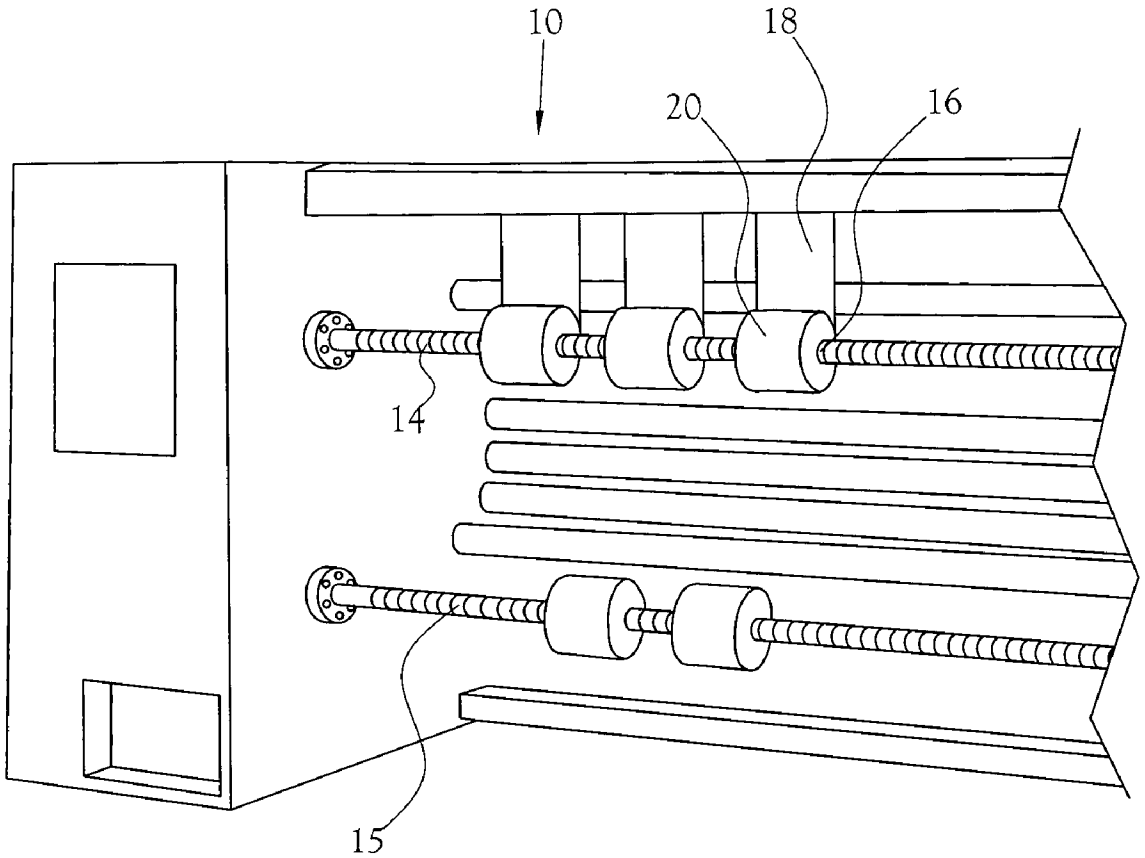
FIG. 1 is a schematic representation of a typical slitter having one or more rewinding shafts and depicting multiple rolls of slit webs collected on the rotable shafts.
Figure 11:
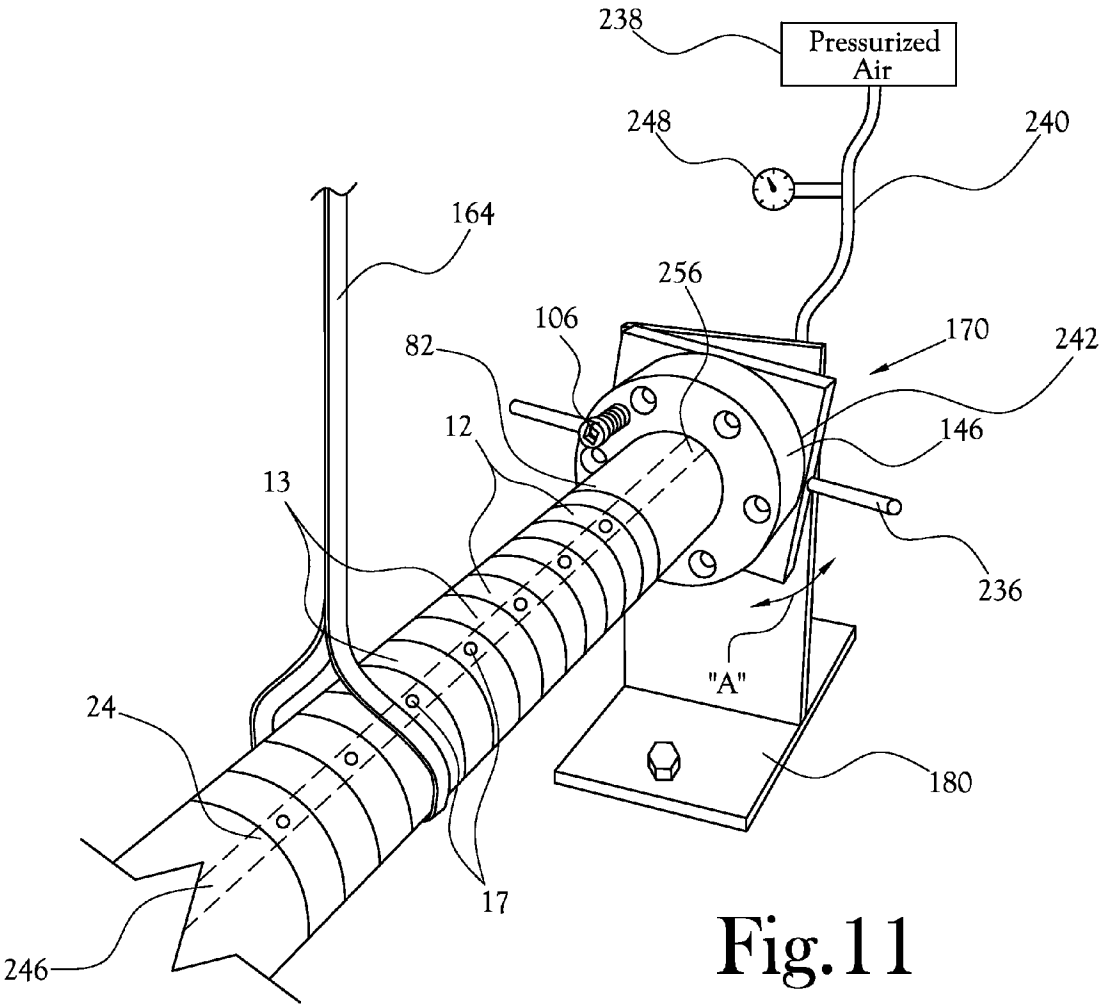
FIG. 11 is a representation of a maintenance mounting bracket and depicting one end of a shaft mounted therein and a hoist associated with the shaft.

With initial reference to FIGS. 1 and 11, a typical slitter/winder device 10 comprises a housing 154 within which there are mounted multiple windup shafts 14 (typical) carrying cores 16 upon which slit webs 18 are to be collected in the form of individual rolls 20 of slit web. Each shaft comprises multiple aspects including a plurality of collars 12 bearing individual detents 17 in their respective outer circumferential surfaces. These collars 12 are separated from one another by respective spacer washers 13. At least one inflatable bladder 24 extends along the length of the shaft and within the collars for actuation of the detents for frictionally maintaining the cores solidly engaged with the shaft when the bladder is inflated. (See FIG. 11).

Figure 2:
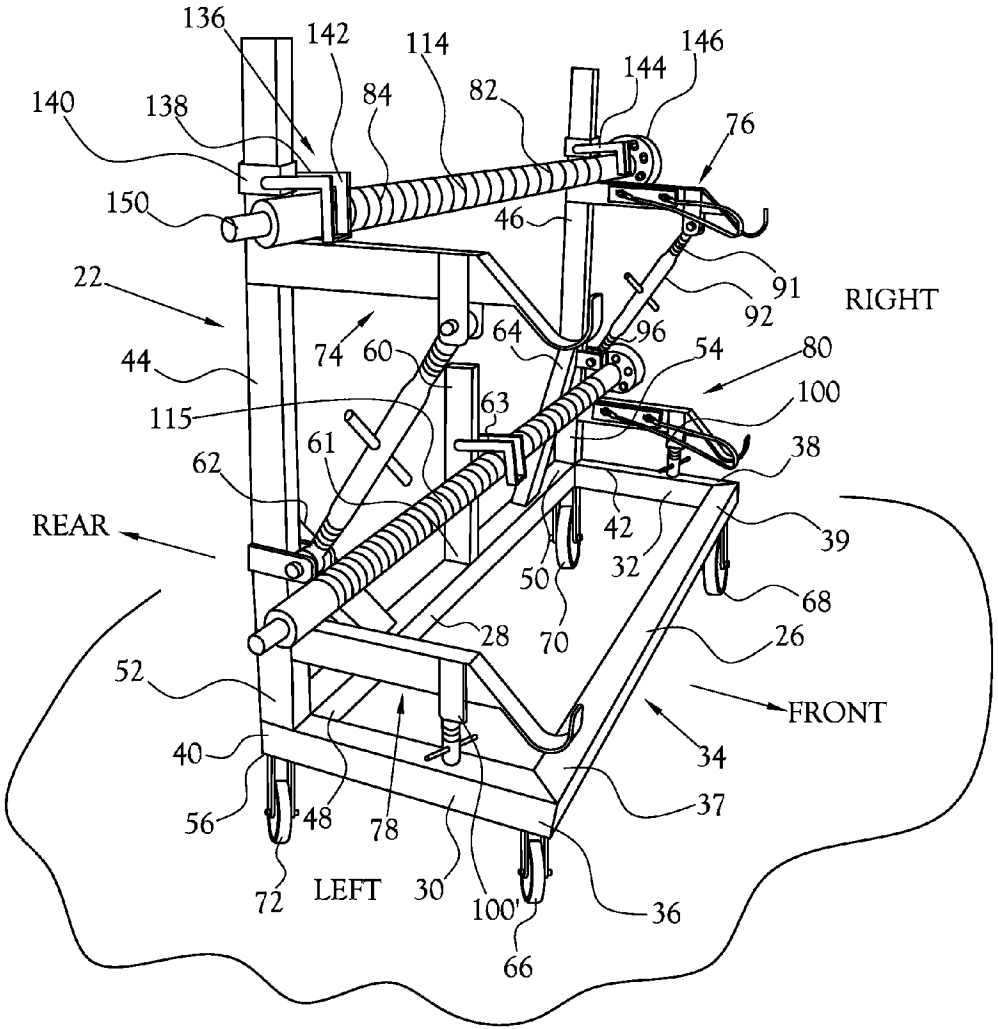
FIG. 2 is a schematic representation of one embodiment of a cart of the present invention depicting the disposition of stored upper and bottom clean shafts on the cart.

In FIG. 2 there is depicted one embodiment of an omni-directionally mobile cart 22 of the present invention preparatory to the exchange of "clean" shafts for "to-be-reconditioned" shafts associated with the slitter/winder. Herein, like components are at times identified by primed numerals. Also at times "clean" and "reconditioned" are used interchangeably.

Figure 3:
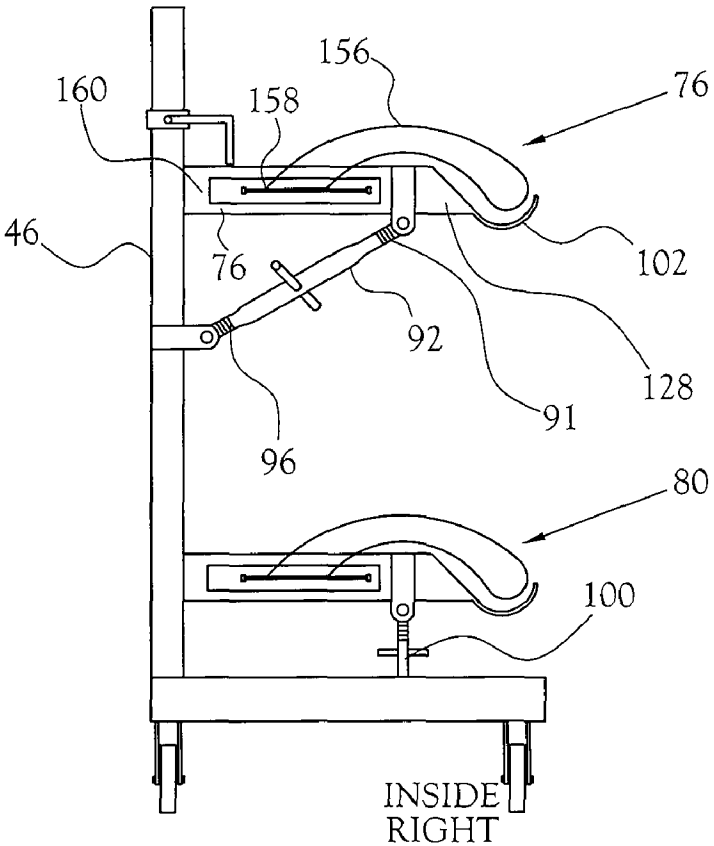
FIG. 3 is a representation of an inside view of the right hand end of the embodiment of the mobile cart depicted in FIG. 2 without shafts.
Figure 4:
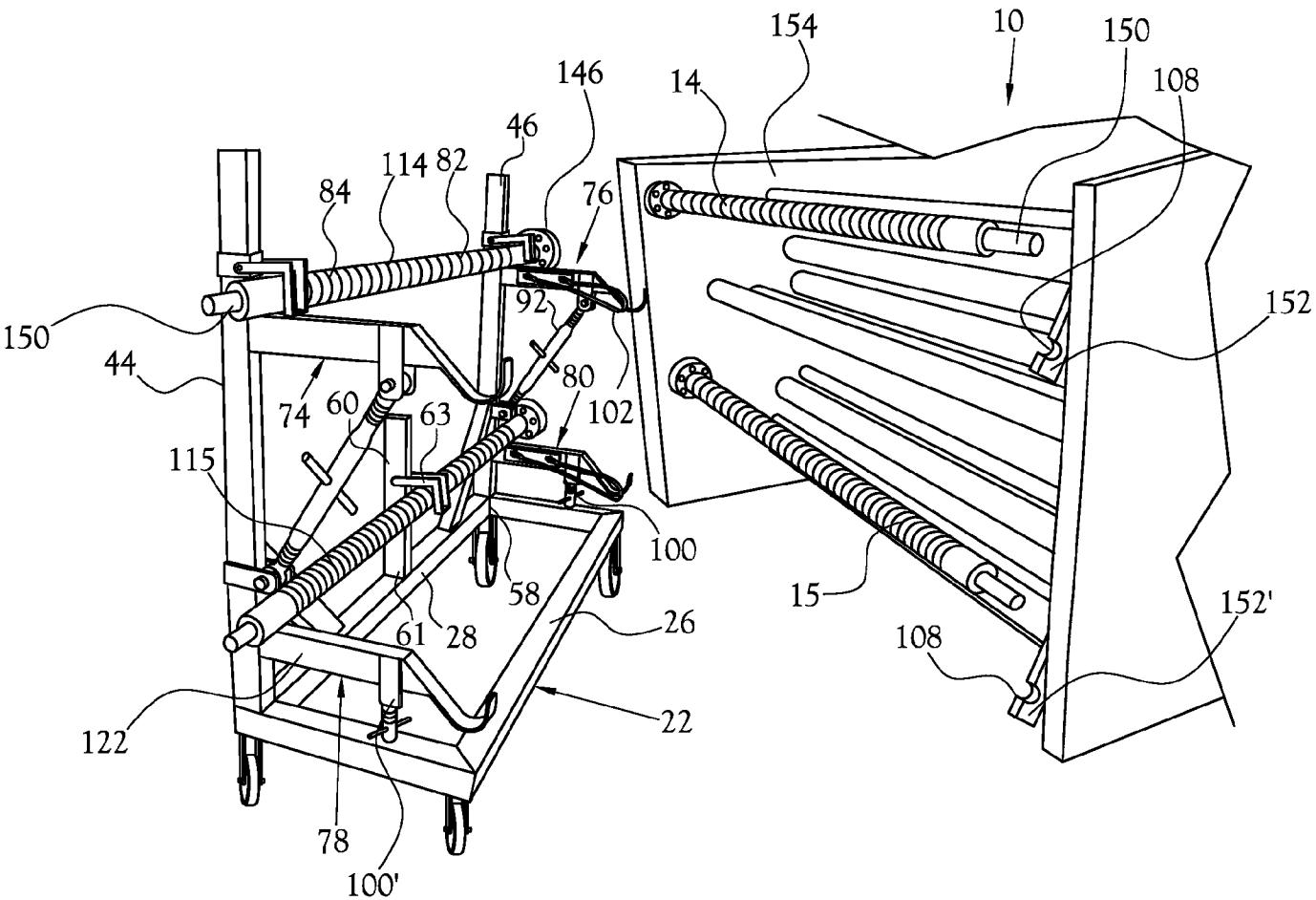
FIG. 4 is a representation of a cart as depicted in FIG. 2 and as disposed preparatory to commencement of shaft exchanges in accordance with one embodiment of the method of the present invention.

Referring to FIGS. 2, 3 and 4, one embodiment of the mobile cart 22 of the present invention may comprise a front bottom rail 26, a rear bottom rail 28 and first and second end rails 30,32 interposed between and joined at their respective opposite first and second rear ends 36,38 to opposite ends 37,39 of the front rail and joined at their respective opposite second ends 40,42 to first and second ends 48,50 of the rear rail 28 to define a rectangular base 34 of the cart 22.

First and second rear upright standards 44, 46 are affixed at their respective bottom ends 52, 54 to opposite ones of the rear corners 56, 58 of the base and are rigidified relative to the base by angular braces 62, 64 which extend from proximate the midpoint of the bottom rail upwardly from the bottom rail to be joined at their respective upper ends to respective ones of the upright standards at a location approximately midpoint of the length of each standard. A further, relatively short, upright standard 60 is anchored at its bottom end 61 to the rear rail 28 of the base and extends upwardly from the rear rail. This standard 60 serves to mount a latch 63 adapted to engage and hold in position, a clean shaft mounted on the arms of the bottom subassemblies 78 and 80. (See FIG. 2).

Bearing supported, 360 degree rotatable wheels 66 and 72 are provided at the two left corners of the base, and providing two bearing supported nonrotatable fixed wheels 68 and 70 provide for easy manual omni-directional movement of the cart over a floor or other supporting surface.

In the embodiment of the mobile cart depicted in FIGS. 2, 3 and 4, the left and right hand ends of the cart, as viewed in FIGS. 2 and 4, are substantially mirror images of one another. As seen in FIG. 3, the right hand inside end view of the cart depicted in FIG. 2, the upright standard 46 is provided with an upper subassembly 76 and a bottom subassembly 80. In like manner, the left hand end of the cart (depicted in FIG. 2) the upright standard 44 is provided with an upper subassembly 74 and a bottom subassembly 78. When assembled as depicted in FIG. 2, the subassemblies on the two standards serve to receive and support respective opposite ends of respective shafts. It will be recognized that the present cart is adapted to simultaneously receive and support multiple shafts. Principally, herein the cart is described in terms of a first upper reconditioned shaft 114 and a first upper to-be-reconditioned shaft 14, both such shafts being disposed at a first vertical level and a bottom reconditioned shaft 115 and a second bottom to-be-reconditioned shaft 15, both such shafts being disposed at a second and lower vertical level on the cart.

Figure 5:
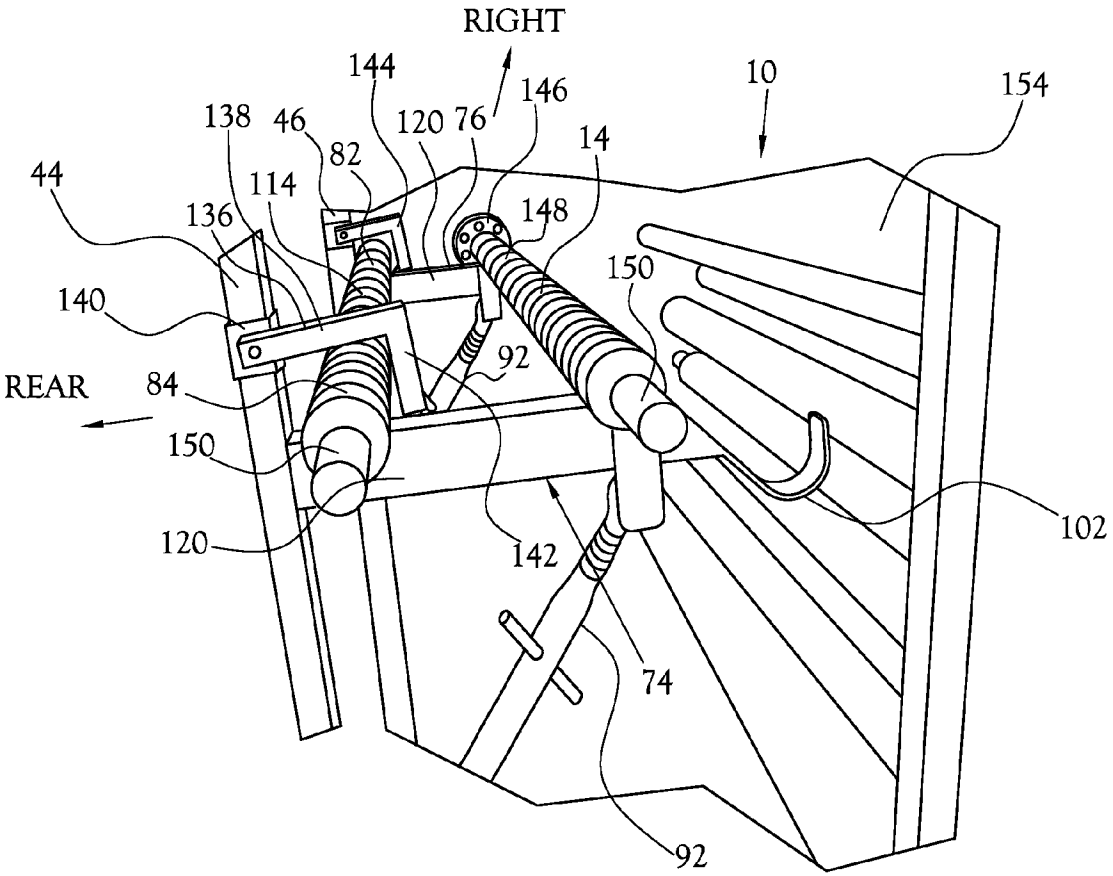
FIG. 5 is a representation of a portion of a cart such as depicted in FIG. 4 and showing the disposition of first and second subassemblies in their respective initial positions for receiving a to-be-reconditioned shaft from the slitter onto the upper edge surfaces of the outboard ends of the arms of the subassemblies and storage of a clean shaft on the inboard ends of the arms of the subassemblies in anticipation of subsequent transfer of such clean shaft on the slitter.
Figure 6:
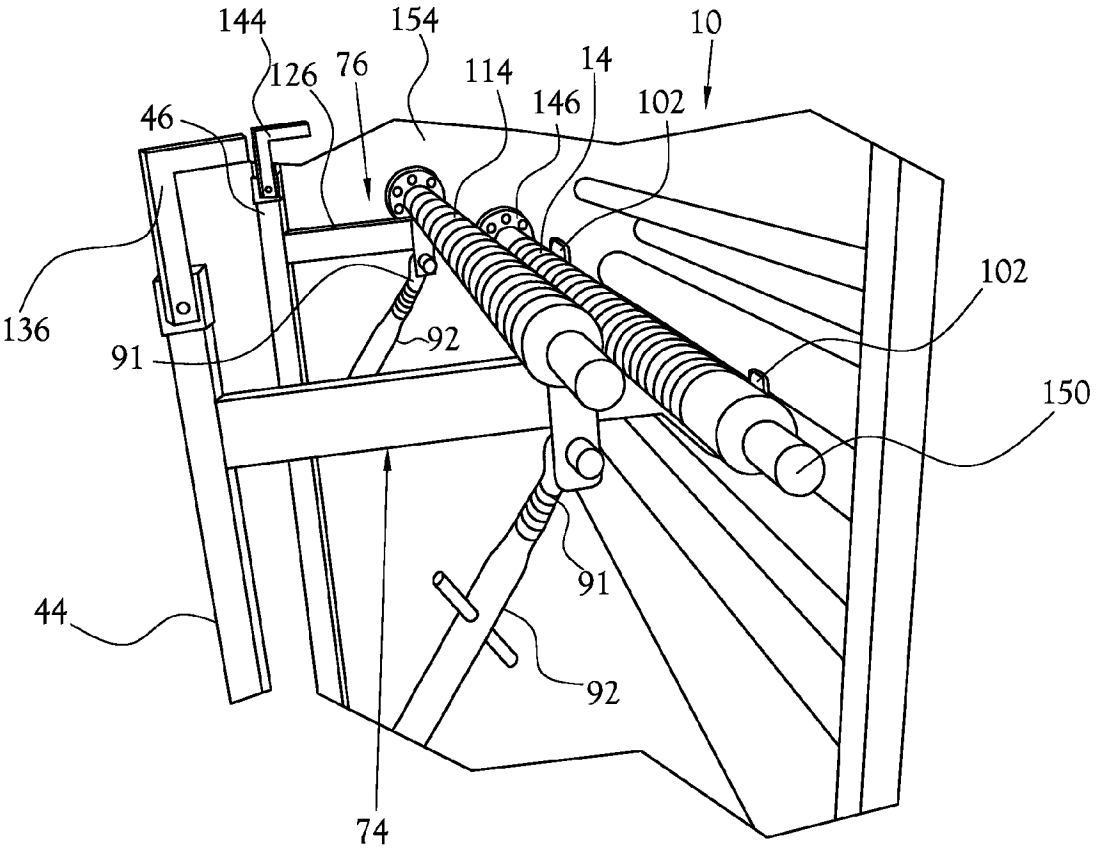
FIG. 6 is a representation of that portion of the cart as depicted in FIG. 5, and the disposition of the first and second upper subassemblies in their respective positions following transfer of the to-be-reconditioned shaft stored in the cradles of the arms of the subassemblies and for the installation of a clean shaft off the arm and onto the slitter.

As depicted in FIGS. 4, 5 and 6, the cart may be positioned relative to the slitter with the upper subassemblies 74 and 76 adapted to underlie and support the first and second opposite ends 82, 84 of a first reconditioned (clean) upper shaft 114 stored on the cart in anticipation of its subsequent installation on the slitter in place of a first to-be-reconditioned upper shaft 14, thereby exchanging the reconditioned upper shaft 114 for the to-be-reconditioned first upper shaft. In FIG. 2, the two bottom subassemblies 78 and 80 are likewise adapted to retain a reconditioned second bottom shaft 115 intended to replace a second bottom to-be-reconditioned shaft 15.

Each subassembly (76, typical and for example) includes a horizontal arm 120 extending laterally outwardly from a respective upright standard 46 of the cart in a substantially cantilevered fashion. (See FIGS. 2, 3, 4, 5, and 6) Each arm includes an inboard end 122 whereby each subassembly is slidably mounted on its respective upright standard as by a respective collar which connects the inboard end of respective ones of the subassembly arms to a respective standard, thereby providing for vertical movement of each subassembly along the length of its respective standard.

Each arm of each subassembly (76 for example) includes a top edge 126, respectively, which is adapted to be disposed in underlying supporting relationship to respective ends of a respective shaft mounted within the slitter. The outboard end 128 of each of the arms of the upper subassemblies 74, 76 is pivotally connected to one end 91 (see FIG. 6) of a turnbuckle 92 whose opposite end 96 is pivotally mounted on a respective upright standard (46 for example) so that manipulation of this turnbuckle functions to adjust the vertical height of each arm to a position of "just touching" engagement with a respective end of a to-be-reconditioned shaft 14 in anticipation of the deposit of the shaft 14 onto the top edges of the arms upon release of the mounting of the shaft from the slitter.

Vertical adjustment of each upper subassembly is effected by means of the respective turnbuckles interposed between the outboard ends of the arms of the subassemblies and approximately midpoint of the respective upright standard on which a respective subassembly is mounted, thereby providing for bringing the top edge of the outboard end of an arm into "just touching" but supporting engagement of a to-be-reconditioned shaft mounted within the slitter. As depicted, the top and bottom subassemblies are adapted to provide like support of the opposite ends of respective shafts and to perform functionally in like manner but at a different vertical level relative to the slitter and with the further exception that the vertical level adjustment of each of the bottom subassemblies is effected by respective vertically adjustable screw jacks 100, 100' interposed between respective end rails of the base and respective bottom subassemblies.

Specifically, the bottom subassemblies 78, 80 serve to engage and support a bottom to-be-reconditioned shaft 15 from the slitter, store this shaft within its cradles, and position a clean bottom shaft 115 for installation in the slitter as a replacement for the bottom to-be-reconditioned shaft 15 removed from the slitter all without altering the originally established position of the cart or the subassemblies.

The outboard end 128 (typical) of each arm 120 (typical) of each of the upper and bottom subassemblies is further provided with a hook-shaped cradle 102 (typical) angling downwardly from the outboard end of respective ones of the arms.

The cradles of the upper subassemblies 74 and 76 serve to receive and support therein a to-be-reconditioned upper shaft 14 (FIG. 4) which has been disconnected from the slitter and initially deposited on the upper edges of the arms of the upper subassemblies prior to it being transferred into the upper arm cradles. The cradles of the bottom subassemblies 78 and 80 likewise serve to receive and support therein a bottom to-be-conditioned shaft 15 which has been disconnected from the slitter and deposited on the upper edges of the arms of the bottom subassemblies, and which thereafter, under resistance, is rolled gently off the ends of the arms and into the cradles on the arms of the bottom subassemblies.

FIG. 4 depicts a mobile cart of the present invention having upper and lower reconditioned shafts 114, 115 resting on the arms of the cart in anticipation of their subsequent installation in the slitter. Each of the shafts in the depicted embodiments of the present invention includes a first end having a mounting disc 146 secured thereon and a second end 150 which is tubular and adapted to be engaged and supported by a pivoting arm 152 (Typical) See FIG. 4) mounted on the slitter housing 154 at a location opposite the mounting location of the mounting disc on the driven end of the shaft 14, for example.

Substantially immediately above the collar which mounts the top arm of an upper subassembly on an upright, there is provided an "L" shaped latch 136, one leg 138 of which is pivotally mounted on the standard 44 by a collar 140 which is slidable along the length of the standard. The opposite leg 142 of the latch, when pivoted away from the standard, overlies one end 84 of a clean shaft resting on the arms of the two upper subassemblies 74 and 76, to preclude such shaft from rolling along the arms. (See FIGS. 2 and 4).

As seen in FIG. 2, a further "L" shaped latch 144 is pivotally mounted on the upright 46 immediately above the top edge of the arm associated with the upper subassembly 76 mounted on the standard 46 and functions in like manner as the latch 136 associated with subassembly 74 to retain a shaft which is resting on the arms.

FIG. 5 depicts a front portion of the cart and shafts of FIG. 4 as the cart is rolled into position with respect to the slitter wherein the arms of the two upper subassemblies of the cart are disposed immediately underneath an upper to-be-reconditioned shaft and the two bottom arms are disposed immediately underneath a bottom to-be-reconditioned shaft on the slitter, The lateral separation distance between the two top arms positions these arms adjacent the opposite first and second ends of the first upper shaft and the lateral separation distance between the two bottom arms positions these arms adjacent the opposite first and second ends of the bottom shaft. Moreover, the overall length of each of the arms permits the outboard ends of the arms to be positioned within the slitter under the shafts mounted in the slitter with the uprights of the cart remaining generally outside the slitter. The required length of each arm of the cart is a function of the slitter itself, but in typical slitters, the arms need only be about 24 inches long.

FIG. 5 depicts the cart and shafts depicted in FIG. 4 with the outboard end of each of the arms of the cart disposed immediately beneath an upper to-be-conditioned shaft 14. Before the cart is so positioned, the operator disengages the arms 152, 152' from the tubular end 150 of each of the shafts 14 and 15, thereby leaving these shafts disposed in cantilevered fashion from the slitter housing by the mounting disc. When so positioned, through manipulation of the turnbuckles 92, each of the arms may be brought into "just touching" relationship to the shaft 14 to supportingly receive the shaft on the arm while relieving any bending stress on the shaft. Upon reaching this position of the outboard end of each of the upper arms being under a shaft on the slitter, the fasteners (bolts 106) employed to mount the driven first end 148 of the shaft 14 to the slitter housing are removed so that the shaft separates from the slitter and rests on the upper arms.

Figure 7:
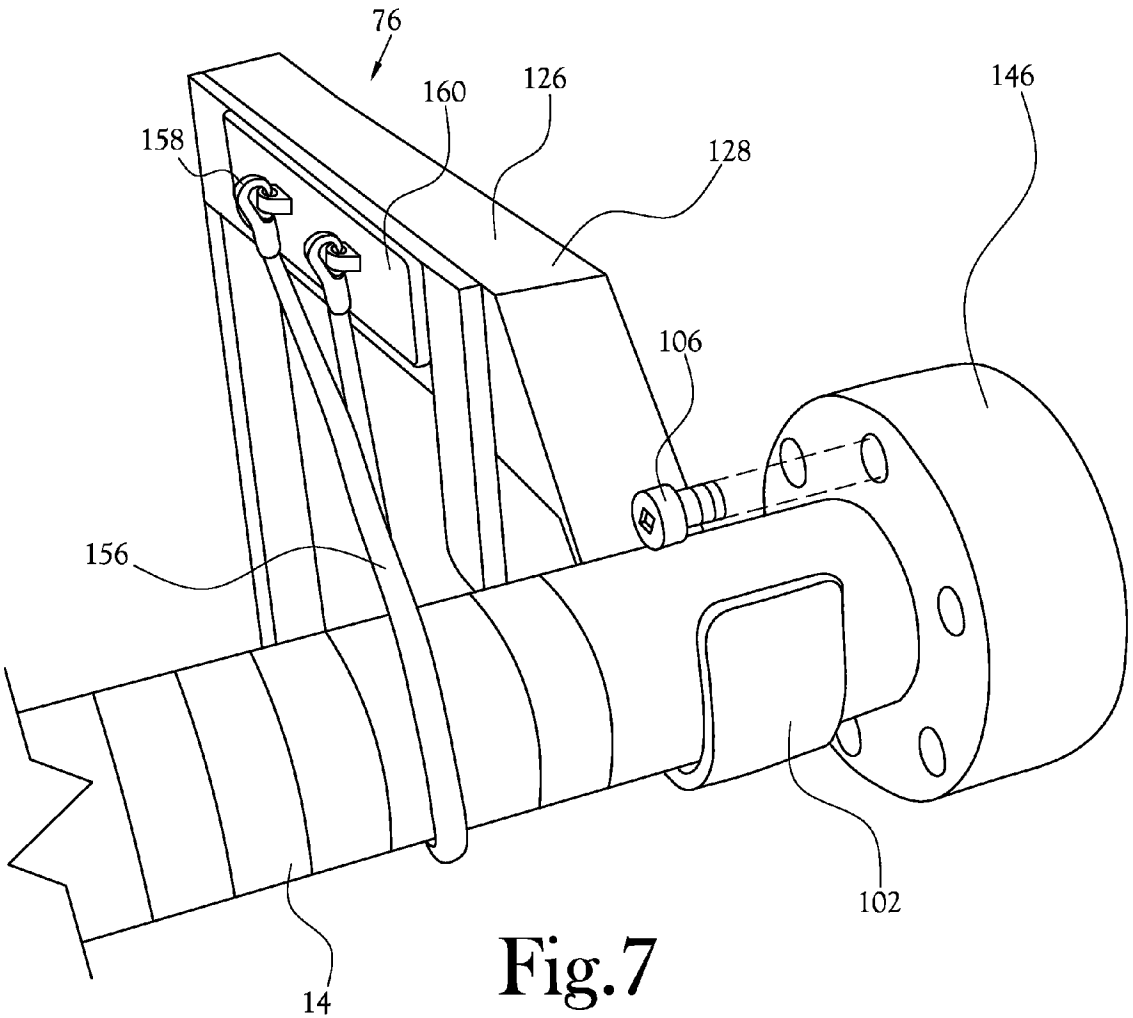
FIG. 7 is an enlarged fragmentary view of one end of a to-be-maintained shaft disposed in a cradle and depicting securement of the shaft within the cradle by an elastic band.
Figure 8:
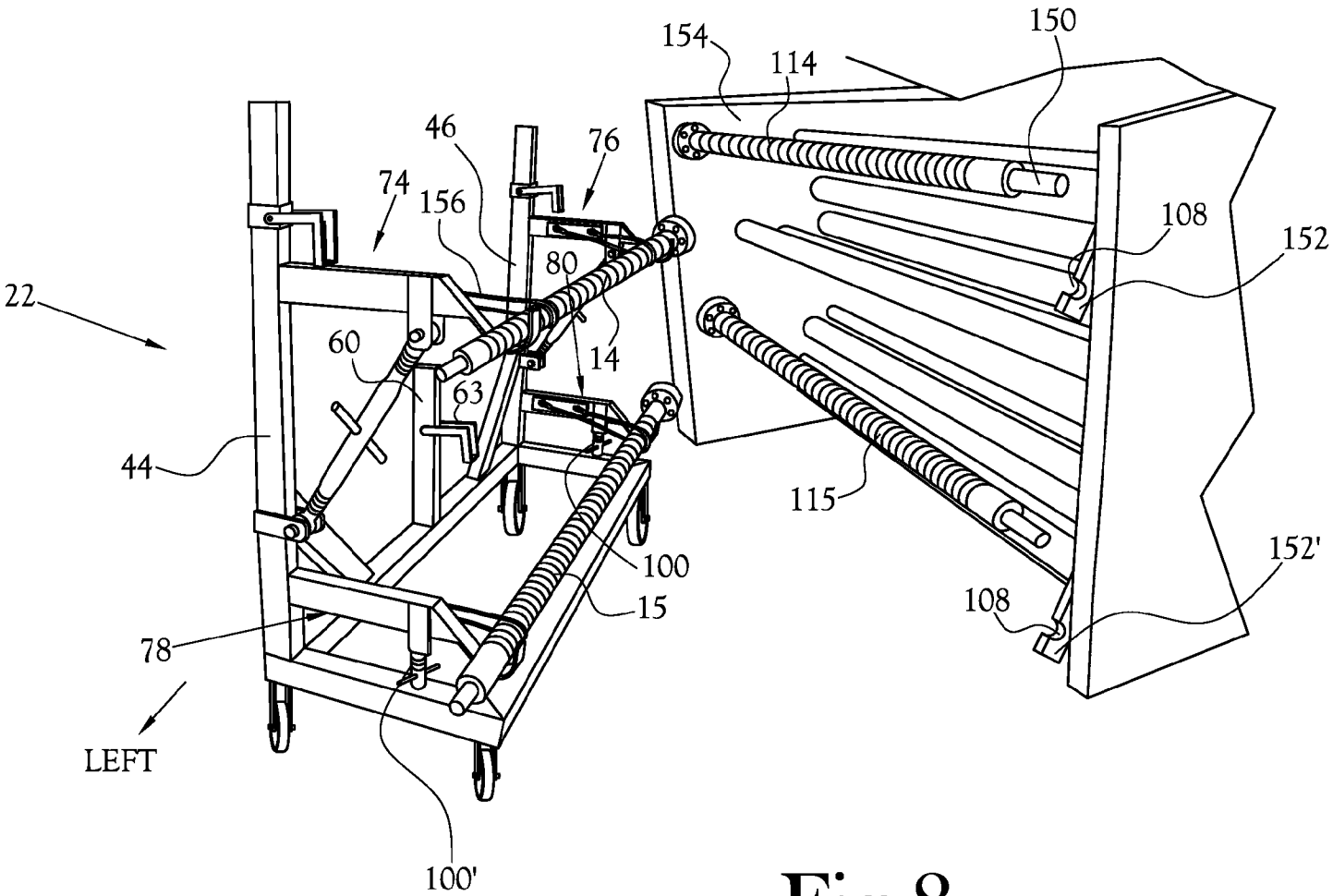
FIG. 8 is a representation of the cart depicted in FIG. 4 and depicting the storage of upper and bottom to-be-reconditioned shafts for transfer to a maintenance station.

As seen in FIG. 7, as an aid to controlling the roll off of the to-be-reconditioned shaft into the upper arm cradles, the inventor provides an elastic band 156 associated with each subassembly having one of its ends 158 releasably anchored onto a side wall 160 of each of the upper arms of the upper subassemblies. Prior to unbolting and fully freeing the to-be-reconditioned shaft from the slitter, at least one end 158 of the elastic band is released from its anchor on the arm and wrapped about the girth of the shaft and returned to its anchor point on the arm. The opposite end of the shaft is likewise wrapped with a further elastic band 156 (shown in FIG. 8) so that the shaft may be rolled forwardly off the outboard ends of the upper arms and lowered, under the resistance afforded by the bands, into the cradles on the outboard ends of the upper arms. These elastic bands serve to reduce the rate of forward movement of the shaft as it is rolled into the cradles and to secure the shaft during subsequent movement of the cart, such as transport of the shaft on the cart to a remote maintenance station.

Once the removed first shaft is seated within its cradles, and without moving the cart or adjusting the vertical level of the arms of the upper subassemblies 74 and 76, the latches 136 and 144 are disengaged from the clean shaft 114 disposed on the arms of the upper subassemblies of the cart and this clean shaft is manually rolled forwardly along the top edge of the upper arms into position to be installed in the slitter at that location formerly occupied by the to-be-reconditioned shaft 14. Notably, no adjustment of either of the upper arms is required to effect this alignment of the clean shaft with the mounting brackets on the slitter due to the retention of the vertical position of the arms during the act of removing the first shaft from the slitter and its temporary storage in the cradles. This feature of the present invention contributes materially to minimization of the overall time required to swap out the to-be-reconditioned shaft with a clean shaft.

This same procedure is followed when removing a bottom to-be-reconditioned bottom shaft from the slitter and into the cradles of the arms of the bottom subassemblies of the cart. Notably, the exchanging of the upper and bottom shafts are carried out without moving the cart.

From FIGS. 4 and 7, it will be noted that one end of each shaft is provided with a mounting disc that is fixed to the end of the shaft in position to be bolted to the housing of the slitter and that the opposite end of the shaft is tubular in geometry and adapted to be rotatably mounted in the slitter. In the depicted slitter this rotatable mounting of this tubular end of the shaft within the slitter takes the form of an elongated support arm 152, 152' pivotally mounted in the slitter housing in opposing horizontal alignment with the mounting location. Each such arm includes a cradle 108 defined in its outboard end and is adapted to swing the outboard end of the cradle between a vertical "out of use" position and a horizontal "in use" position.

In those instances where there are both upper and lower shafts to be replaced during a single operation, once the upper shaft is in its cradles and its reconditioned shaft has been mounted within the slitter, attention is directed to the vertical alignment of the arms of the bottom subassemblies disposed immediately underneath the bottom shaft and adjusting the arms of the bottom subassemblies into their "just touching", but supporting, relationship to the opposite ends of the bottom to-be-reconditioned shaft 15 employing the screw jacks 100 and 100' associated with the bottom subassemblies. When so aligned, the bottom to-be-reconditioned shaft is released from the slitter, encircled by elastic bands about its opposite ends, and lowered into the cradle extensions on the outboard ends of the arms of the bottom subassemblies, all in like manner as described hereinabove for disengaging the upper first shaft from the slitter and loading it onto the cart and installation of the reconditioned shaft.

Figure 9:
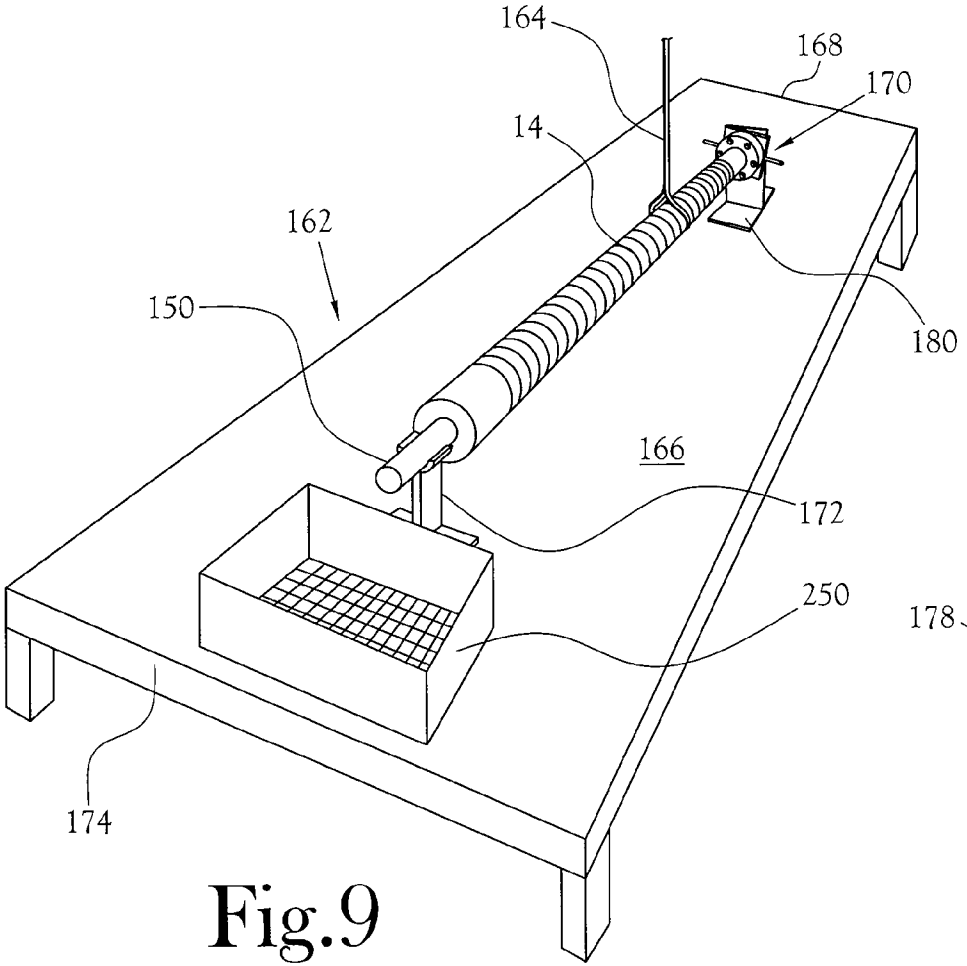
FIG. 9 is a representation of one embodiment of a maintenance station of the present invention depicting a shaft mounted within the station.

With the removed shaft or shafts disposed within their respective cradles, the cart may be manually withdrawn from the slitter and manually rolled to a remote maintenance station 162. As seen in FIG. 9, within this maintenance station, a first one of the shafts on the cart is lifted, as by a hoist 164 or other suitable means, and transferred from the cradles on the arms of the cart to the maintenance station 162 of the present invention.

Figure 10:
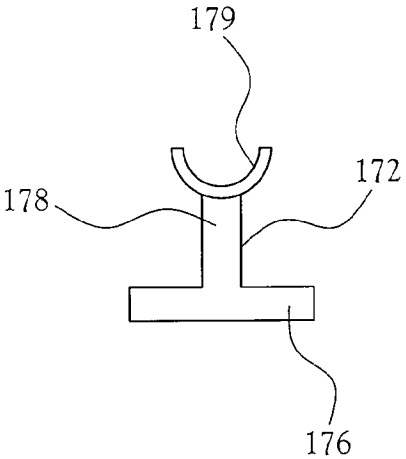
FIG. 10 is a representation of a removable support stand for the outboard end of a cantilevered shaft mounted in the mounting bracket of the maintenance station.

Referring to FIGS. 9 and 11, the maintenance station of the present invention includes a supporting surface 166, such as a table top of a length preferably slightly greater than the overall length of the shaft 14 to be reconditioned. At a forward end 168 of the table top, the present inventor provides an upstanding mounting bracket 170 adapted to receive the first end 82 of the shaft 14, which includes the "bolt-on" mounting disc 146, and a further upstanding mounting support 172 (see FIGS. 9 and 10) proximate the rearward end 174 of the table top and adapted to rotatably support the tubular end 150 of the shaft 14 while also permitting this support to be removed to thereby permit the sliding of the multiple collars 12 and spacer washers 13 off such tubular end 150 of the shaft.

The upstanding mounting bracket 170 of the maintenance station for supporting the first end 82 of a shaft 14 to be reconditioned, mimics the mounting disc 146 employed for anchoring of the first end 82 of the shaft to the slitter. To this end, the mounting bracket 170 as depicted in FIGS. 9, 11-15, comprises a base 180 of generally planar rectangular geometry having an upstanding generally planar wall 182 extending upwardly from the approximate midline of the base. This wall is buttressed by multiple gussets 186, 188 and 190 disposed on a front face 192 and in the junction 194 of the bottom 196 of the wall with a first exposed surface of the base and terminating at approximately the midline 184 of the wall whereby the remaining upper portion 200 of the wall above the gussets is flat and planar.

Generally within the boundary of this upper flat planar portion 200 of the wall 182 there is mounted a flat planar plate 202 having a throughbore 210 defined through the thickness centrally of the plate. This plate is rotatably secured in place on the wall as by means of a cylindrical stub shaft 206 which is welded to the plate coincident with the throughbore 210 and which is insertable through a throughbore 210 defined in the wall.

Figure 13:
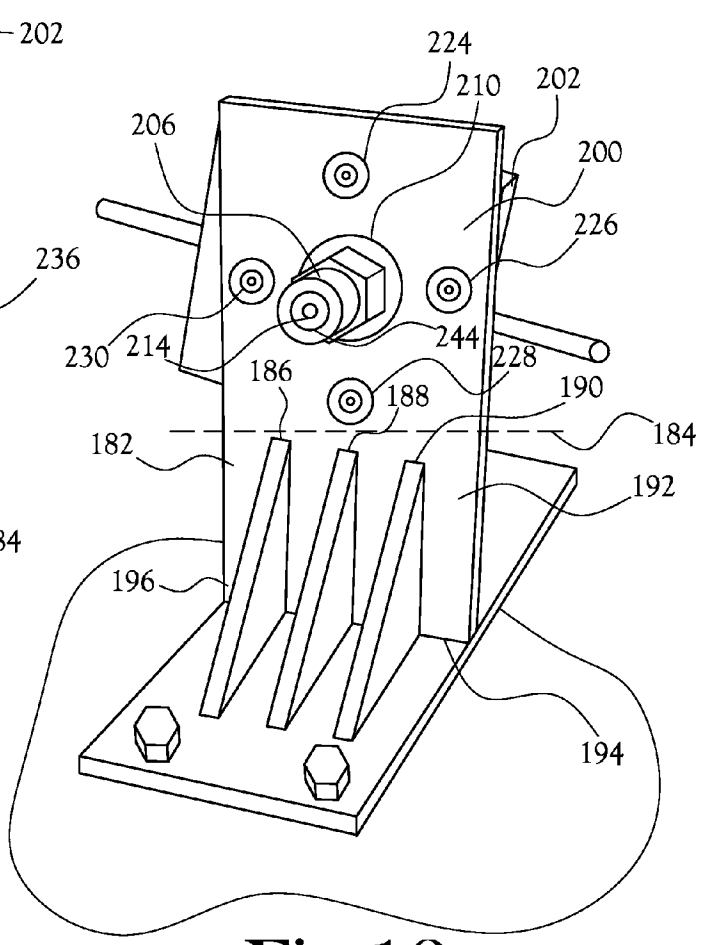
Figure 12:
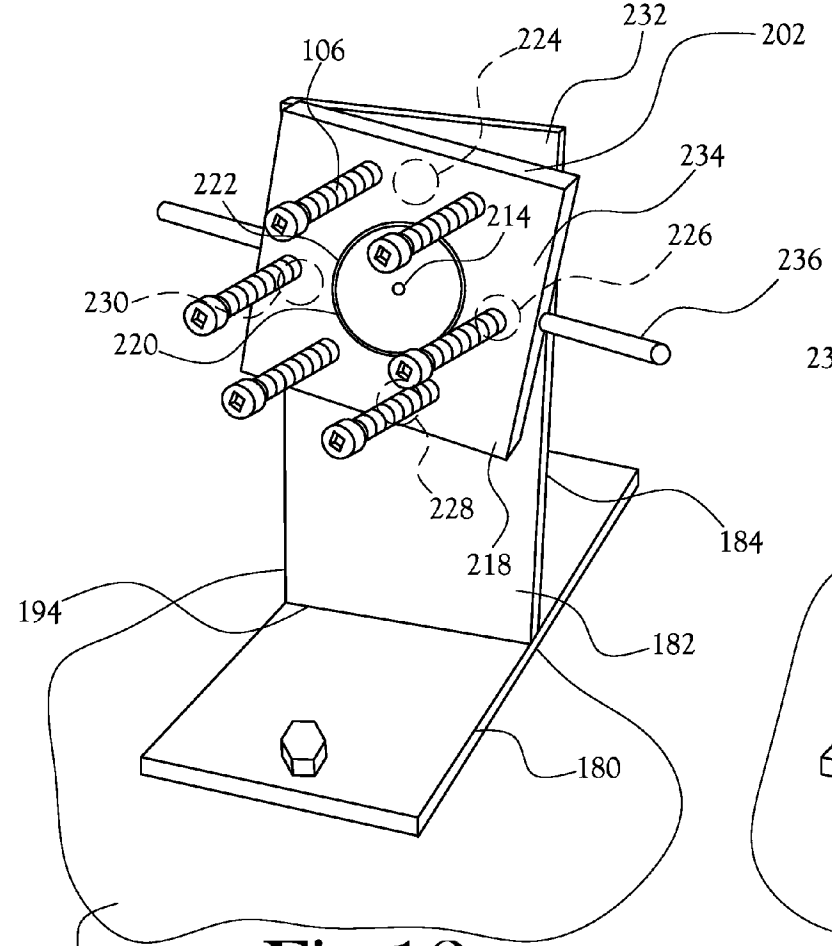
FIG. 12 is a front side representation of one embodiment of a maintenance mounting bracket; and, FIG. 13 is a rear side representation of the mounting bracket depicted in FIG. 12.
Figure 15:
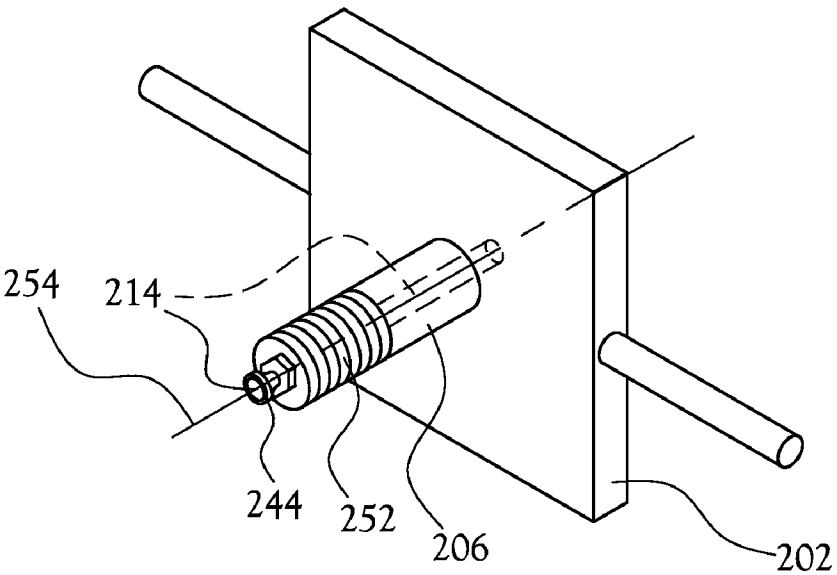
FIG. 15 is a representation of a plate of a mounting bracket depicted in FIG. 14.
Figure 14:
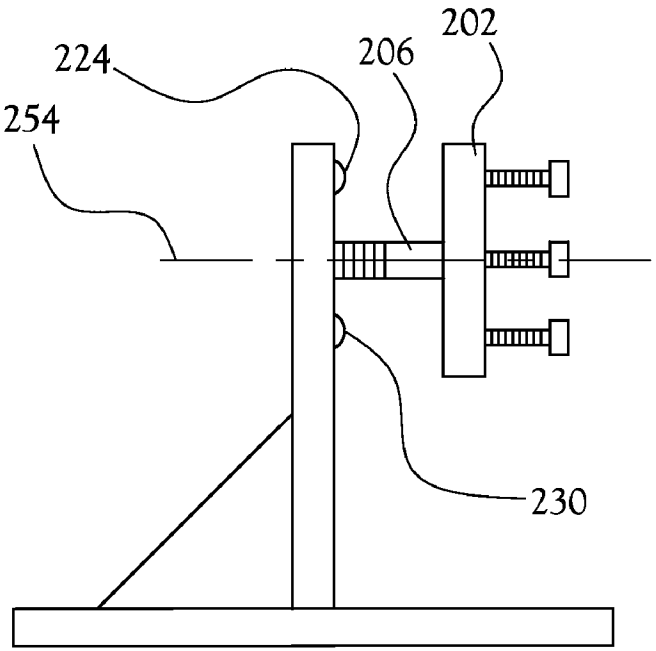
FIG. 14 is a partially exploded side elevation view of one embodiment of a mounting bracket of the maintenance station for mounting a shaft in position for reconditioning; and one embodiment of a plate of a mounting bracket as depicted n FIG. 12.

In FIG. 14, the plate and the stub shaft welded thereto are depicted in an exploded view. When the plate is fitted onto the wall, the plate engages a pattern of spaced apart bearings 224, 226, 228, and 230 which protrude from the inboard face 232 of the wall and provide for solid support of the plate for ready rotation of the plate relative to the wall and about the longitudinal centerline 254 of the stub shaft 206 which is fixed to the plate. Referring to FIGS. 11, 12 and 13, it will be seen that in the depicted embodiment of the mounting bracket 170, multiple, preferably four, ball bearings 224, 226, 228 and 230 are embedded within respective openings defined through the thickness of the wall to the extent that one surface of each bearing will protrude from the outboard face 232 of the remainder 200 of the wall at equally spaced apart locations about the outer periphery 234 of the plate, and as outlined employing dashed lines in FIG. 12. These protruding ball bearings serve to both position the plate parallel to the face of the wall and to rotatably support the plate relative to the face of the wall.

The stub shaft is drilled along its longitudinal length fully therethrough, thereby providing a passageway 214 through which air may flow from externally of the stub shaft and into an air tight open space 242 defined between the plate and mounting disc 146 of the shaft 14 when the shaft is bolted to the plate as by the bolts 106. To this end, the outboard face 218 of the plate is provided with a circular trough 220 concentrically of the longitudinal centerline 254 of the stub shaft, for receipt therein an O-ring 222 or like air-tight seal to thereby define an air tight open space 242 between the mounting disc of the shaft and the outer face of the plate when the mounting disc is mounted on the plate. The passageway through the stub shaft is in fluid communication with this open space.

Further, the threaded end 252 of the stub shaft is internally taped to accept a check valve 244 screwed therein, thereby providing for control over the direction of flow of air from a source of pressurized air 238 remote from the mounting bracket 170, through the air passageway defined through the stub shaft and into the open space 242 bounded by the O-ring and between the outboard face of the plate and the mounting disc of the shaft. (See FIG. 11).

As depicted in FIG. 11, the shaft 14 includes at least one inflatable bladder 24 which has one end 256 thereof anchored in air flow communication with the open space 242 between the plate and the mounting disc of the shaft and its opposite end 246 closed so that pressurized air entering the open space serves to inflate such bladder and activate the detents associated with the multiple collars that are mounted on the shaft. (See FIG. 11).

By these means, compressed air may be transmitted from a source of compressed air 238 remote from the mounting bracket through a conduit 240 leading from such source and connecting to the exposed outboard end of the stub shaft of the plate. In a preferred embodiment, there is provided a check valve 244 interposed within the opening through the stub shaft and the conduit whereby the direction of flow of pressurized air through the stub shaft can be chosen through operation of the check valve. The check valve does not regulate how much air goes into the shaft, all it does is once air is supplied to the shaft it prevents it from escaping. The amount of air that goes into the system is gauged by a regulating valve which is interposed the outside source of pressurized air, along the length of the conduit, for example.

As seen in FIGS. 9,11, and 13, within the maintenance station, the shaft is anchored to the mounting bracket 170 by positioning the throughbores through the disc in alignment with threaded bores defined at spaced apart locations about the outer margin of the plate and then securing the disc to the plate as by threaded bolts 106. This mounting of the disc to the plate accomplishes gas sealing engagement of the disc with the O-ring in the face of the plate, and second, positioning the shaft suspended in substantially rigid cantilevered relationship to the plate and the supporting surface 166, whereby rotation of the plate may be employed to rotate the shaft for cleaning as needed, and/or visual inspection. The outboard end of the cantilevered shaft does not require physical support in the present invention. As desired for any of various reasons, physical support of such outboard end of the shaft may be provided by means of a support stand 172 comprising a flat base plate 176 supporting an upstanding standard 178 which is topped with a "U" shaped cradle 179 adapted to loosely receive the outboard end of the shaft therein as desired. Notably, this support may be readily withdrawn from its position of support for the outboard end of the shaft for purposes of permitting a user to slide the collars and spacer washers from the shaft for cleaning, etc. and subsequent reassembly on the shaft. Rotation of the plate may be controlled by means of one or more handles 236 appended to and projecting from respective side edges of the plate. (See arrow "A" in FIG. 11).

As is known in the art, a multi-component slitter shaft of the type disclosed herein commonly includes a plurality of elongated inflatable air bladders 24 (typical) which extend along the length of the shaft. Air flow communication from the open space through the air passageway through the stub shaft, which passes through the plate and the wall of the mounting bracket, thence to the bladder, is established via the conduit 240 to a source 238 of pressurized air. A first end of each of such bladders is secured either directly to the disc or by one or more adaptors interposed between the bladders and the mounting disc, or other suitable interconnection of the bladders to the source of pressurized air. The second and opposite end 246 of each bladder is closed so that pressurized air admitted to the first end of the bladders enters and inflates each bladder. In the present invention, an air pressure gauge 248 is interposed along the length of the conduit leading from the pressurized air source to the mounting bracket. As seen in FIG. 13, an air check value 244 in the passage way defined through the stub shaft and a pressure regulating value 248 supplying a selectable amount of pressurized air to the shaft through the air check value. Once the shaft is supplied with the correct amount of air pressure, the air source is removed and the check valve holds the pressure within the shaft. Deflation of the bladders over time is indicative of a leak. Thereupon the bladders may be reinflated and bubble checked to locate such leak. Thus, once the bladders are inflated using pressurized air of a chosen pressure as indicated on the pressure regulator gauge, any leakage of any one of the bladders will express itself in a drop in the pressure indicated at the pressure gauge, thereby giving warning to the user of the leakage. Once the location of the leak has been determined, the bladder may be patched or otherwise repaired or replaced with a new bladder. Deflation of the air bladders may be effected by opening the check valve associated with the stub shaft. Repetitions of the pressure testing of a new bladder or one or more of the original bladders, may be performed at the maintenance station before the shaft is returned to the slitter with obvious savings in time and cost. Notably, such visual inspection of the shaft and the pressurized air testing of the bladder may be carried out without changing the initial mounting of the shaft on the maintaining bracket or otherwise rearranging the initial mounting of the shaft on such mounting bracket within the mounting station.

In one embodiment of the present invention, the collars 12 and spacer washers 13 of a shaft may be collected in a mesh basket 250 and immersed in an agitated volume of a cleaning solution, for example, for removal of dust, dirt or other undesirable material which may have collected on these items during operation of the slitter.

Further, the ability of the user to manually rotate the shaft in its cantilevered attitude provides ease of inspection for physical damage or wear and tear of all internal aspects of the shaft, and/or making any needed repairs or maintenance of such internal aspects of the shaft requiring such actions.

Following the repair, cleaning, relubrication (if needed) and other required reconditioning of the disassembled components of the shaft, such cleaned and relubricated components are reassembled onto the shaft commencing at the outboard end of the shaft. When fully reassembled, the clean shaft is returned to a location on either the upper or bottom arms of the cart in position for storage in anticipation of its subsequent installation into the slitter. Retention of the clean shaft on the arms may be provided by means of the "L" shaped latches 136, and 144 which are pivotally mounted on respective ones of the upright standards of the cart as seen in FIG. 5.

The present invention encompasses a method for maintaining a multi-component shaft having at least one air bladder adapted to urge detents disposed in respective collars mounted along the length of the shaft into frictional engagement with one or more cores encircling the shaft comprising the steps of:

a. providing a multi-directional manually operable cart adapted to remove at least one shaft from a slitter or similar item of equipment, the cart including a plurality of vertically adjustable arms extending substantially horizontally outwardly from the cart, each arm including a top edge and an outboard cradle depending from the outboard end thereof, b. disposing the cart in operative proximity to a shaft to be removed from the slitter, c. adjusting the vertical level of the arms to position the top edge of each of the outboard ends of the arms in underlying supporting engagement with the shaft to be removed from the slitter, while maintaining substantially horizontal alignment of the each arm, d. releasing the shaft from the slitter whereupon the shaft becomes solely supported proximate the outboard ends of the arms, e. employing a restraining force, moving the shaft past the outboard ends of the arms into the cradles projecting from the outboard ends of respective ones of the arms, f. moving the cart and the shaft resting thereon from the slitter to a maintenance station disposed remote from the slitter;

g. within the maintenance station, transferring the shaft from the cart cradles and positioning the shaft over a supporting surface, h. providing in the maintenance station a mounting bracket which substantially mimics the mounting bracket employed to mount the first end of the shaft within the slitter;

i. anchoring the first end of the shaft on the mounting bracket of the maintenance station whereby the shaft extends from the mounting bracket generally horizontally and suspended in cantilevered fashion from the mounting bracket, j. dissassemblying the shaft, including sliding of multiple ones of the components of the shaft from the outboard end of the suspended shaft, k. inspecting, cleaning and/or repairing or replacing each of the multiple components of the shaft;

l. reassembling the inspected, repaired, cleaned or new components of the shaft as needed to produce a clean shaft, m. storing the clean shaft on the cart for future installation of the shaft in a slitter.

In one embodiment, the shaft is overwrapped at each end of the shaft with a flexible elastic band, whereby movement of the shaft off the arms requires stretching of the elastic bands and thereby restricts the rate of movement of the shaft past the outboard ends of the arms and into the cradles.

Alternatively, the method may be altered to simultaneously deliver to the slitter upper and bottom clean shafts and in course to remove two shafts for reconditioning and replacement of these same two shafts with the two clean shafts carried by the cart, all without altering the initial positioning of the cart relative to the slitter.

What is claimed:

1. A system for exchange and reconditioning of winding or rewinding shafts associated with a web handling device comprising an omni-directional cart adapted to receive, support and store thereon at least one shaft in need of reconditioning and at least one reconditioned shaft, said cart including a base adapted to be moved omni-directionally upon a supporting surface, said base including first and second upright standards mounted on said base at laterally apart locations, a first subassembly adapted to be positioned at various vertical locations along the length of said first upright standard, and a second subassembly adapted to be positioned at various vertical locations along the length of said second upright standard, each of said subassemblies including an arm extending outwardly generally horizontally from a respective upright standard in generally cantilevered fashion, each such arm including an exposed upper edge and an outboard end, a height adjustment device operatively mounted on said base and in association with a respective one of said subassemblies whereby said height adjustment device is adapted to raise or lower its associated subassembly, independently of the other of said subassemblies, between various vertical locations along the height of its associated upright standard to position said arms of said subassemblies in underlying engagement with at least one shaft mounted in operative association with said web handling device and whereupon disassembly of said at least one shaft from said web handling device deposits said at least one shaft on said upper edges of said first and second subassemblies, a shaft storage cradle mounted on said outboard end of each arm at a location proximate said upper edge of said arm and depending from said outboard end of said arm in position to receive and temporarily store therein at least one end of said shaft mounted on said web handling device and in need of reconditioning, each arm of each of said subassemblies providing a support location for a reconditioned shaft suitable to be substituted for said shaft in need of reconditioning in anticipation of the removal from said web handling device of said shaft in need of reconditioning, said support levels being adapted to support said reconditioned shaft in an attitude whereby movement of said reconditioned shaft along said arms positions said reconditioned shaft for mounting of said reconditioned shaft on said web handling device in lieu of said disassembled shaft without adjustment of the vertical, horizontal or angular attitude of said cart.

2. The system of claim 1 wherein said cart includes a third subassembly mounted on said first upright standard for movement between various height locations along said first upright standard at various vertical locations below said first subassembly, and a fourth subassembly mounted on said second upright standard for movement between various height locations along said second upright standard below said second subassembly, said third and fourth subassemblies being of like construction and functional equivalence as said first and second subassemblies for purposes of storing on said arms a reconditioned shaft and for removing from the web handling device and storing of a further shaft in need of reconditioning, all at a vertical level below the vertical level of said first shaft in need of reconditioning.

3. The system of claim 1 wherein each of said first and second subassemblies is adjustable to respective vertical heights along respective ones of their upright standards independently of one another.

4. The system of claim 1 and including a maintenance station adapted to receive from said cart said at least one shaft in need of reconditioning, said maintenance station including a supporting surface, a mounting bracket affixed to said supporting surface and extending upwardly from said supporting surface, said mounting bracket being adapted to receive one end of said shaft in need of reconditioning and support such shaft in a substantially cantilevered fashion above said supporting surface whereby said shaft is positioned for ready disassembly of various components of said shaft and reassembly of said components after reconditioning of the same.

5. The system of claim 4 wherein said mounting bracket of said maintenance station substantially mimics the mode of mounting of the end of the shaft as provided for mounting of the same end of said shaft in said web handling device.

6. The system of claim 5 wherein said mounting bracket for said shaft provides for rotation of said shaft along its longitudinal axis while mounted in said mounting bracket.

7. The system of claim 6 and including provision for controlled measured application of a pressurized gas into one or more inflatable bladders disposed along the length of the shaft, including rotation of said shaft without alteration or modification of the initial mounting of said shaft on said mounting bracket in its cantilevered attitude relative to the supporting surface of said maintenance station.

8. The system of claim 1 wherein said cart is manually multi-directionally moveable over a supporting surface.

* * * * *